US005100133A

United States Patent [19]

Riviezzo et al.

[11] Patent Number: 5,100,133

[45] Date of Patent: Mar. 31, 1992

[54] BASKETBALL GAME CONTROLLING ASSEMBLY

[76] Inventors: Fred A. Riviezzo, 273 E. Shawmont Ave.; Vincent Riviezzo, 303 Lodge Rd., both of, Philadelphia, Pa. 19128

[21] Appl. No.: 741,622

[22] Filed: Aug. 7, 1991

[51] Int. Cl.[5] ..... A63B 63/08

[52] U.S. Cl. ..... 273/1.5 R; 273/354

[58] Field of Search ..... 273/1.5 R, 354, 398–402

[56] References Cited

U.S. PATENT DOCUMENTS

| | | | |
|---|---|---|---|
| 1,574,201 | 2/1926 | Lynch | 273/1.5 X |
| 2,061,152 | 11/1936 | Guthrie | 273/1.5 R |
| 2,247,852 | 7/1941 | Saunders | 273/342 |
| 2,257,934 | 10/1941 | Bell | 273/1.5 R |
| 2,413,952 | 1/1947 | Chervenka | 273/1.5 X |
| 2,593,758 | 4/1952 | Holmdahl | 273/1.5 R |
| 2,617,653 | 11/1952 | Keller | 273/1.5 X |
| 2,999,233 | 9/1961 | Dresbach | 273/1.5 R |
| 3,362,712 | 1/1968 | Wagner | 273/1.5 X |
| 3,795,401 | 3/1974 | Voltz | 273/1.5 A |
| 3,910,574 | 10/1975 | Voltz | 273/1.5 A |
| 4,858,920 | 8/1989 | Best | 273/1.5 R |

FOREIGN PATENT DOCUMENTS

| | | | |
|---|---|---|---|
| 7905257 | 1/1981 | Netherlands | 273/1.5 R |
| 1568410 | 5/1980 | United Kingdom | 273/354 |

*Primary Examiner*—Paul E. Shapiro

*Attorney, Agent, or Firm*—Terry M. Gernstein

[57] ABSTRACT

The scoring during a basketball game is controlled by an assembly that is connected to the game period ending buzzer circuit to automatically close the basket net when the buzzer circuit is activated to signal the end of a period of the game. The assembly includes a cord intertwined in the net and connected to a spring. The spring biases the cord into a net closing position, and the assembly further includes a spring override system that prevents the spring bias from closing the net during the game. The spring override system is connected to the period ending buzzer circuit to be released at the end of a period. The spring override system can be set to delay the release of the spring for any suitable length of time if desired.

6 Claims, 2 Drawing Sheets

BASKETBALL GAME CONTROLLING ASSEMBLY

TECHNICAL FIELD OF THE INVENTION

The present invention relates to the general art of games, and to the particular field of basketball games.

BACKGROUND OF THE INVENTION

Various types of games, such as basketball games, extend for a predetermined period of time, with that time being divided into separate periods that also have definite times. Scoring in such games is frequent, and the outcome of a game may depend upon determination of whether or not a particular play occurred during the running time of the game. In other words, many basketball games have had the outcome thereof hinge on whether a basket was scored before the game or period ended. A determination of whether or not a basket achieved at the end of a game or at the end of a period is often a judgement call of the officials. The official must determine when the game or period ended by listening for a buzzer, often when the crowd is quite noisy, and then making a mental determination if the shot should count. To say the least, this judgement call is difficult to make, and is often quite controversial.

Therefore, the art contains devices for determining if a scoring play occurred during or after a playing period has expired. While somewhat effective, these devices are not entirely successful and satisfactory because spectators, or even other officials, coaches and players are not immediately aware of whether a shot counted or not. This delay may remove some of the enjoyment from the game.

Therefore, there is a need for a device that can control a basketball game by automatically determining whether a basket was scored during the playing time of the game, and which makes such determination immediately apparent to all spectators, players, officials and coaches.

OBJECTS OF THE INVENTION

It is a main object of the present invention to provide a device that can control a basketball game by automatically determining whether a basket was scored during the playing time of the game.

It is another object of the present invention to provide a device that can control a basketball game by automatically determining whether a basket was scored during the playing time of the game, and which makes such determination immediately apparent to all spectators, players, officials and coaches.

SUMMARY OF THE INVENTION

These, and other, objects are achieved by an assembly that is automatically activated by a buzzer system used to indicate the end of a period of a basketball game, and once activated, closes the basketball net in a manner that prevents a basketball from falling through the net.

A ball thus trapped immediately indicates that the shot will not count. All spectators, players, coaches and officials are immediately informed that the shot does not count, and the outcome of the game is immediately apparent to all.

BRIEF DESCRIPTION OF THE DRAWING FIGURES

DETAILED DESCRIPTION OF THE PREFERRED EMBODIMENT OF THE INVENTION

Figure 1:
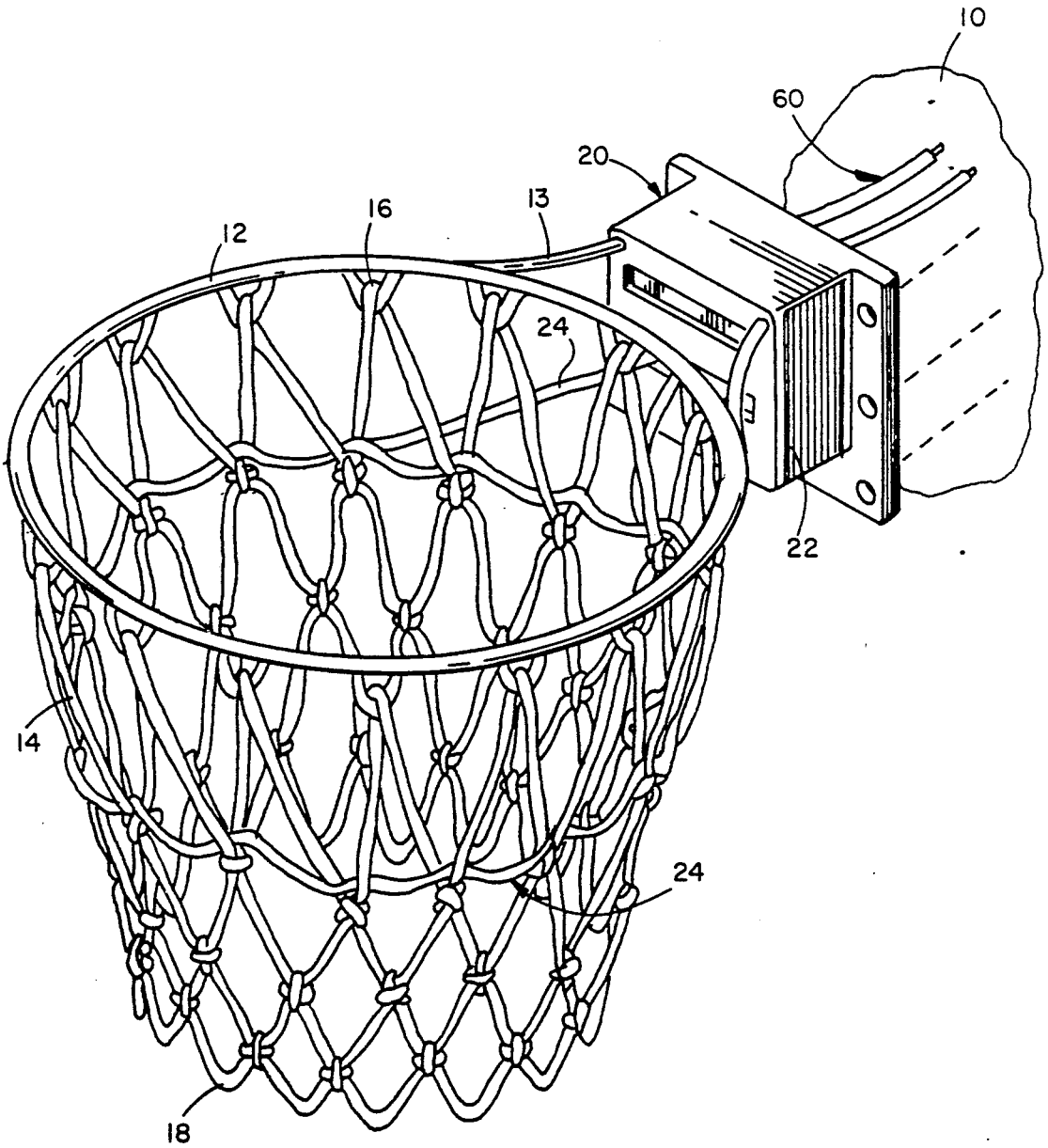
FIG. 1 is a perspective view of a basketball hoop having a net closing assembly embodying the present invention connected thereto.

Shown in FIG. 1 is an indication of a basketball backboard 10 of the type commonly used in professional and amateur basketball games. A basket hoop 12 is mounted on this backboard by supports 13, and a flexible basketball net 14 is supported at a top end 16 thereof on that hoop in the usual manner. A basketball falling through the hoop also falls through the net and exits the net via the bottom 18 thereof.

As discussed above, it is often important to be sure that a shot falling through the hoop 12 is scored before the end of a period of the game. In most cases, this is a judgement call by an official. As such, this can be a controversial call that is subject to human error. In order to remove the judgement from this call, the present invention provides a net control assembly 20 mounted on the backboard 10 to cinch the net 14 in a manner that prevents a basketball from falling through the net, even after that ball has passed through the hoop. The net control assembly 20 is automatically activated by the activation of a game-period ending buzzer or horn circuit. In this manner, there is no human judgement involved, and the results of the shot will be immediately apparent to all since the ball will either pass through the net (thereby indicating that the shot will count) or will be captured in the net (thereby indicating that the shot does not count).

Figure 2:
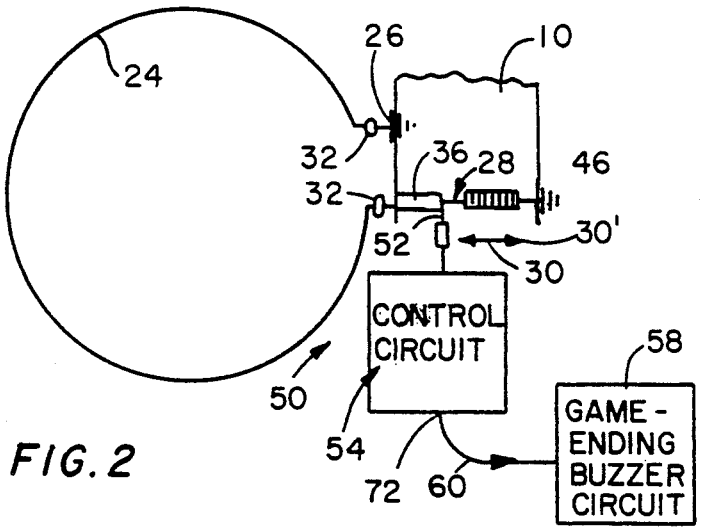
FIG. 2 illustrates a basketball net control assembly having a net closing cord connected to a cord control circuit that is connected to a game period ending buzzer circuit.

The net control assembly 20 is best shown in FIGS. 1 and 2 as including a housing 22 mounted directly on the backboard between the net and that backboard. A net-closing cord 24 is intertwined with the net 14 between the net top 16 and bottom 18. The cord 24 has one end 26 fixedly mounted or anchored to the housing 22 or directly on the backboard. This end 26 is thus stationary with respect to the remainder of the cord. The cord has a second end 28 that is movable with respect to the end 26 whereby the cord can be cinched closed. The second end 28 is movable toward and away from the backboard as indicated by the double-headed arrow 30 in FIG. 2. The housing 22 includes cord guides 32 thereon whereby movement of the cord second end moves the net in a manner to prevent the ball from passing out of the net. The cord second end 28 can be moved far enough towards the backboard to simply trap the ball between the net and the backboard if suitable. The amount of movement for end 28 is controlled by elements discussed below, and movement toward the backboard, i.e., net closing movment, is indicated in FIG. 2 by direction arrow head 30'.

The cord end 28 is connected to the backboard by a turnbuckle 36 having a ends 38 and 40 threadably attached to screw threads 42 and 44 fixed to portions 24' and 24", respectively, of the cord 24. These screw threads 42 and 44 can be integrated directly into the cord or can be part of sleeves that are fixed to the cord. By adjusting the turnbuckle, the movement of the cord can be controlled.

A spring 46 is connected at one end 48 thereof to the cord portion 24" and at the other end thereof to the backboard. The spring 46 is a compression spring that is biased to pull cord portion 24" in direction 30'. The amount of movement of the cord portion 24" is set according to the dimensions of the spring 46 and are set to either totally close the net 14 or move that net far enough towards the backboard to trap a basketball in the net between the cord 24 and the hoop and the backboard.

The bias of the spring is countered by a spring override means 50. The override means 50 includes the turnbuckle 36 acting as a stop element on the cord, and a stop engaging element 52 that engages the turnbuckle end to prevent the spring bias from moving the cord in direction 30'. The stop engaging element can engage the turnbuckle end 40 on the outside of the turnbuckle or can engage the turnbuckle end 38 on the inside of the turnbuckle as suitable.

Figure 5:
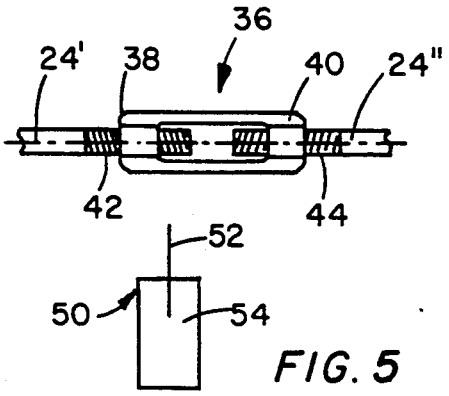
FIG. 5 is a turnbuckle used in the net control assembly.

The stop engaging means is moved from a first position engaging the stop element as shown in FIG. 2 to a second position spaced from that stop engaging position as indicated in FIG. 5, by a moving means 54, with the stop engaging means being in the first, stop engaging position, during a game, and in the second, stop releasing, position at other times.

Figure 3:
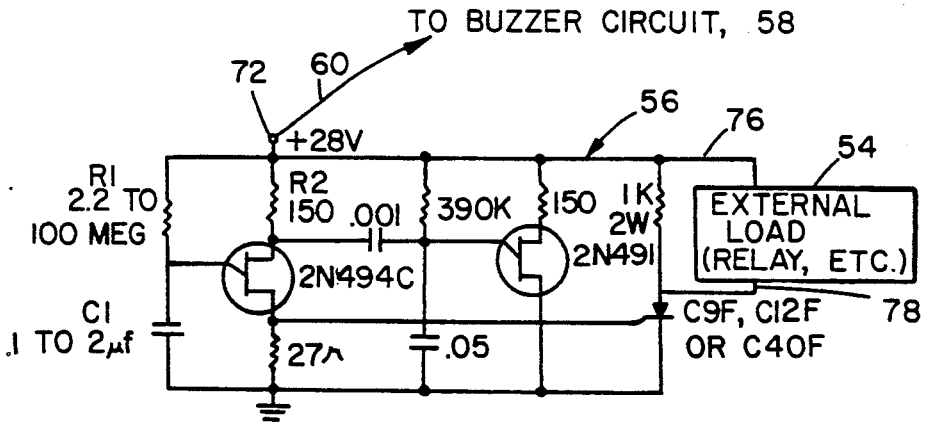
FIG. 3 is a diagram of the circuit used to draw the net closing cord closed upon activation of the period ending buzzer circuit.
Figure 4:
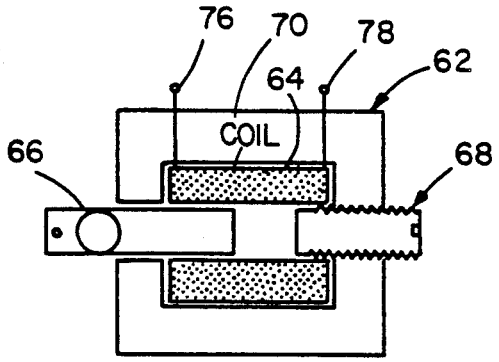
FIG. 4 illustrates a solenoid that is used in the net control assembly.

The moving means 54 is best shown in FIGS. 2 and 3, and includes a control circuit 56 connected to the game period ending buzzer or horn circuit 58 by suitable line conductors 60. Activation of the period ending buzzer automatically activates the moving means to move the stop engaging means from the first, FIG. 2, position to the second, FIG. 5, position thereby releasing the spring 46 to move the cord 24 in direction 30'.

The preferred form of the stop engaging means is a solenoid 62 having an electrically energized coil 64 that produces a magnetic field therewithin to move a rod 66 toward stop 68 when energized. The coil is located within a housing 70.

The solenoid 62 is energized by circuit 56. The preferred form of the circuit 56 is a solid state time delay circuit that can delay activation of the solenoid from 0.3 milliseconds to over 3 minutes as necessary. The amount of time delay is set as necessary to comply with the rules of the game that may, for example, permit a shot to count if it has passed through the hoop before the buzzer sounds, or to prohibit any shot that has not passed through the net before the buzzer sounds. The time delay circuit 56 uses a tantalum or electrolytic capacitor. The timing is initiated by applying power to the circuit from the buzzer circuit 58 via connection 72. The length of the timing interval is determined by the value of the resistance R1 multiplied by the value of the capacitance C1, i.e., R1C1. The value of R1 can be altered if that resistor is a potentiometer. The 2N494C fires the controlled rectifier. This places the supply voltage minus about one volt across the solenoid via line conductors 76 and 78. As soon as the supply voltage is applied to the solenoid, it activates thereby releasing the spring to draw the cord in direction 30'.

It is understood that while certain forms of the present invention have been illustrated and described herein, it is not to be limited to the specific forms or arrangements of parts described and shown.

What is claimed is:

1. A basketball game controlling assembly comprising:
   (A) a basketball backboard;
   (B) a basketball hoop mounted on said backboard and including a flexible basketball net supported on said hoop and having a top end attached to said hoop and a bottom end, said net being sized to permit a basketball to move therethrough; and
   (C) a game scoring control means which includes
      (1) a game period ending buzzer circuit which is activated to signal the end of a period of a basketball game,
      (2) a net control assembly mounted on said backboard adjacent to said net and including
         (a) a net-closing cord anchored at one end thereof to said backboard and attached to said net,
         (b) a spring mounted at one end thereof on said backboard and attached at another end thereof to a second end of said cord, said spring being biased to pull said cord second end toward said backboard,
         (c) a spring override means connected to said cord and including a stop on said cord, and a stop engaging element movably connected to said backboard,
         (d) moving means for moving said stop engaging element from a first position in engagement with said stop to a second position spaced from said stop, said spring drawing said cord second end toward said backboard and cinching said net when said stop engaging element is in said second position, said stop engaging means being in said first position during a game, and
         (e) control circuit means for connecting said stop engaging element moving means to said game period ending buzzer circuit and moving said stop engaging element from said first position into said second position when said game period ending buzzer circuit is activated.

2. The basketball game controlling assembly defined in claim 1 wherein said stop engaging element includes a solenoid.

3. The basketball game controlling assembly defined in claim 2 wherein said circuit means includes a resistance/capacitance combination.

4. The basketball game controlling assembly defined in claim 3 wherein said circuit means further includes a controlled rectifier.

5. The basketball game controlling assembly defined in claim 4 wherein the resistance in said resistance/capacitance combination is a potentiometer.

6. The basketball game controlling assembly defined in claim 5 wherein said stop includes a turnbuckle on said cord.

* * * * *